US005887801A

United States Patent [19]

Stevens

[11] Patent Number: 5,887,801

[45] Date of Patent: Mar. 30, 1999

[54] HIGH PRESSURE HOSE RECOIL REDUCTION DEVICE

[76] Inventor: Barry A. Stevens, 199 Southridge St., Springfield, Vt. 05156

[21] Appl. No.: 868,428

[22] Filed: Jun. 3, 1997

[51] Int. Cl.[6] ..... B05B 1/14

[52] U.S. Cl. ..... 239/590; 239/590.5

[58] Field of Search ..... 239/310, 461, 239/462, 468, 499, 542, 590, 590.5; 169/14, 15

[56] References Cited

U.S. PATENT DOCUMENTS

| | | | |
|---|---|---|---|
| 894,558 | 7/1908 | Wheaton | 239/590 X |
| 1,722,733 | 7/1929 | Coffey et al. | 239/468 |
| 1,886,623 | 11/1932 | Barnes | 239/590 X |
| 3,642,213 | 2/1972 | Parkison et al. | 239/590 |
| 4,830,280 | 5/1989 | Yankoff | 239/590 X |
| 5,131,591 | 7/1992 | Gill | 239/590 X |

*Primary Examiner*—Andres Kashnikow
*Assistant Examiner*—Steven J. Ganey
*Attorney, Agent, or Firm*—Kevin Ellicott, Esq.

[57] ABSTRACT

A high pressure hose recoil reduction device comprising a body having a first opening, a hollow chamber, and a second opening, the first opening and the second opening being axially offset from one another. The first opening having locatable thereon an attachment for connecting to a high pressure line, the second opening having attached thereto a flow restrictor and a nozzle attachment through which the high pressure material which has entered through the first opening, contacted an oppositely aligned inner surface of the chamber and passed through the chamber must flow, before exiting through a nozzle attached to the device.

5 Claims, 5 Drawing Sheets

HIGH PRESSURE HOSE RECOIL REDUCTION DEVICE

B

FEDERALLY SPONSORED RESEARCH AND DEVELOPMENT

There are no federally sponsored or funded research or development projects or undertakings in any way associated with the instant invention.

C

BACKGROUND OF THE INVENTION

1. Field of the Invention

The instant invention relates to that field of devices consisting of articles of manufacture known as high pressure hoses and nozzles. Specifically, the instant invention is a device for use with such high pressure hoses, the device being configured to reduce the recoil effect caused by materials exiting under pressure, from a nozzle at an end of those hoses.

2. Background Information

The prior art known to applicant discloses that high pressure lines are well known, and commonly used. These lines rely upon the pressure produced by a mechanical device to propel materials through them. Often, this is accomplished by connecting the high pressure line to a compressor or like device. Examples of materials delivered under high pressure include water, air, sand, and various other colloidal materials.

In the prior art, the output end of the high pressure hose is connected directly to a delivery means, such as a nozzle. The material which is under pressure is directed through the nozzle in a stream.

Unfortunately, the releasing of materials through the nozzle, under high pressure, produces significant reaction forces which must be offset by the individual using the high pressure line. These forces may be relatively simple to overcome (as is the case with a garden hose having only the pressure found in a home's water lines), more difficult to overcome (as is the case with a "sand blaster" having the pressure produced by a fairly sizable mechanical air compressor), or very difficult to overcome (as is the case with a fire hose having the pressure produced by a city water main and pumper fire truck, in conjunction). In each of these cases, the individual using the high pressure hose must invest physical effort in order to offset the reaction force produced at the nozzle.

The amount of effort required to offset the reaction force (or recoil) becomes a serious consideration when the ability to manipulate the nozzle is important. When one uses a garden hose, for example, the recoil is relatively easy to offset by holding onto the nozzle tightly, and directing the flow. However, as the pressures involved increase, so do the efforts required in order to overcome the recoil effect. In the case of the user of a sandblaster, for example, this additional force requirement on the part of the user may detract from the user's ability to dexterously direct the flow of materials exiting the nozzle under pressure. In the case of a fire hose high pressure line, the additional force requirement may be so significant as to require multiple individuals all holding onto the hose, and directing its output in unison. Where the users of the high pressure hose (firemen) are trying to not only direct the output efficiently and dexterously, but also need to move about, and avoid being hit by a burning building's structural elements, this additional manpower and effort to overcome the recoil effects can become not only difficult, but deadly as well.

Additionally, the requirement of more than one user on a particular hose in order to overcome the recoil effect caused by the high pressure water limits the personnel available for other tasks. Most "fire companies" have a limited number of fire fighters available at any point in time. If 3 out of 4 of those fire fighting personnel are busy holding onto one hose, they are not free to accomplish other important tasks such as search and rescue. Furthermore, by utilizing the instant invention and freeing up those persons who would normally be holding onto one hose, there will be more available personnel for additional hoses. This would lead to more rapid extinguishing of fires, and a reduction in property loss as a result.

There have been various devices which incorporated chambers, but which did not reduce the recoil produced by the high pressure material as it exited the nozzle. These have been utilized by fire fighters and are commonly known as "foggers". For example, the John C. Schellin patent, U.S. Pat. No. 1,996,884 (Fog-Producing Nozzle) sought to break the high pressure water into a particulate "fog" and thereby smother fires. To do this, the Schellin '884 device directed the high pressure water into an angled nozzle which directed the water against an impeller blade. The impeller blade set to spinning, and the water passing through it was broken into a particulate "fog-like" consistency. In addition, a certain amount of the high pressure water was directed randomly towards the inner walls of the chamber. Unfortunately, this device severely hampered the fire fighter's ability to direct the liquid any distance from the nozzle. The blade/chamber combination had the overall effect of reducing the output pressure significantly. Output pressure, in the field of fire fighting for example, is a serious concern, and devices which diminish that pressure in the fashion which the '884 patent did are not useful to fight fires at any distance from the nozzle.

Until the instant invention, no one had proposed a device which could reduce the recoil produced by materials passing through a nozzle, under high pressure while maintaining an output pressure similar to the input pressure.

One attempt had been made at stabilizing the gyroscopic precessional effects produced by a fluid passing through a high pressure line in Douglas F. Koeppe, U.S. Pat. No. 3,804,336 (Stabilized Fire Hose). However, this device required the user of the high-pressure line to move the nozzle in directions different from the intended direction of the spray flow. This steering of the nozzle in a different direction from that which the user actually wanted the water to flow is counter intuitive, and requires training. In a situation such as the one in which a fireman is already under significant environmental stress, this addition of another counter intuitive variable is undesirable.

Reduction of recoil has been accomplished in other arts (such as hand guns), however, these devices have relied upon the venting of gasses in order to offset the recoil. Venting the pressure of a high pressure line would be an unsatisfactory arrangement as it would require that the pressure propelling the material be increased in order to offset the loss, and still maintain nearly the same pressure at the nozzle as in the line. In activities such as fire fighting, this would be an unacceptable solution as it would require that city water lines and pumper trucks be redesigned in order to produce the additionally required pressure.

D

SUMMARY OF THE INVENTION

The instant invention, known to Applicant as the "JVM BASE", is a device configured for interposition between a high pressure hose and a nozzle which, when in use, will decrease the recoil produced by materials passing out of the nozzle under high pressure.

The device is constructed of a body having an input attachment means for connecting to a hose or like high pressure delivery mechanism; the body having a chamber, a flow restriction means and an output attachment means for connecting to a nozzle or like output device. When in use, the high pressure material passes through a hose, into the input attachment means and is directed against an oppositely aligned chamber front side inner surface of the device. The material then flows through the chamber and into the flow restriction means. The flow restriction means directs the high pressure material into the output attachment means, and out of the nozzle.

When in use, the high pressure material is directed against the chamber front side inner surface of the device, transferring a portion of that high pressure force. The chamber then fills, and the high pressure material is directed through the flow restriction means. As understood by Applicant, the cross sectional diameter of the flow restriction means should be substantially similar to the cross sectional diameter of the tip of the nozzle which is being utilized. Having passed through the flow restriction means, the high pressure material then moves out through the output attachment means and exits the device through output end of the nozzle.

Unlike those devices which rely upon the venting of gasses in order to offset recoil pressure or those devices which produce a "fog-like" water output, the instant invention requires little loss of pressure between the high pressure line and the output end of the output device. For example, when used in conjunction with high pressure water and a smooth bore ¾ inch tip nozzle, the pressure of the water exiting the nozzle after passing through the device will still nearly correspond to the pressure at the tip of the same type of nozzle used without Applicant's device. This is of incredible importance to the user of a high pressure water hose while fighting a fire. A device which vented the pressure or redirected some of the pressure force to mechanically spin an impeller could not be counted upon to be able to deliver water, under the necessary pressure, to fires occurring at a distance (on the second or third floor of a building, for example).

Furthermore, the device requires no specialized training in order to become proficient in its use. Unlike the device found in the Koeppe '336 patent, Applicant's device may be used intuitively, in the same fashion which a high pressure nozzle is normally used without any recoil reducing device. The instant invention does not require that the user try to point the nozzle leftward in order to redirect the material flow upward. If a user of the instant device wishes to reorient the material flow upward, the user need only point the nozzle upwardly, as one would intuitively do.

Additionally, the device may be used in conjunction with almost any material which flows similarly to a fluid, when under pressure. The device does not require that the material flow through rotating blades, as do the Koeppe '336 and Schellin '884 patents. Therefore, the instant invention may be utilized with materials which would badly damage or destroy the mechanism located in the chamber of the Koeppe '336 or Schellin '884 patents. This allows the instant device to be used between the high pressure line and the nozzle of devices such as sand blasters, bead blasters, and other high pressure dispensers of colloidal materials.

Furthermore, by utilizing a flow restriction means and increasing the pressure of the high pressure material flowing out of the chamber, after redirecting the full force of high pressure material, but before releasing the high pressure material through the output device, the instant invention produces an output pressure at the nozzle tip nearly the same as the a nozzle tip not used in conjunction with the instant device. Fog producing devices, such as the Schellin '884 device may utilize an internal nozzle to redirect the flow of high pressure material in the chamber, but make no attempt to increase that high pressure material's pressure so as to offset any pressure loss which may be experienced when the device acts upon the high pressure material. Hence, the instant invention can assure its user that the material will leave the device with sufficient pressure to accomplish the desired task, while at the same time reducing the recoil which would normally be experienced.

Additionally, the instant invention may be used in many other situations where recoil may not be as significant as that found in fire fighting, but may nonetheless be an annoyance, discomfort or distraction. For example, many commercial car washing establishments now offer equipment on site which allows a car owner to wash his or her own car. High pressure water is delivered to the bay in which the car is to be washed via a high pressure hose line. The line, in turn, is connected to an elongated nozzle or "wand". When the car owner turns the pressure on, that wand has a tendency to "jump upward and backward", and is difficult to handle while attempting to direct the water flow. By inserting the instant device between the high pressure hose and the wand (as an add on, or by incorporating the device into the wand), the recoil pressure which makes these wands unwieldy may be significantly diminished, thereby freeing the user of the device to concentrate on spraying dirt off his or her car rather than trying to hold onto the wand without getting soaked.

When the device is used in the field of fire fighting, it may be configured for use with both the conventional nozzle (smooth bore nozzle) and the combination nozzle (Boston combination tip). It may also be configured so as to allow adjustment in order to compensate for the use of nozzles having various tip diameters.

It should be remembered that when the flow through a hose remains constant, but the tip diameter of a nozzle changes, the reaction force at the nozzle will also change. For example, if the nozzle pressure (psi) is maintained at 50 and the nozzle tip diameter changes from ¾ inch to 1 inch, the corresponding nozzle reaction (expressed in pounds) will change from 44 to 78. Hence, it is may be desirable to configure the device such that the distance between the front side inner surface and the point at which the high pressure material exits the input attachment means is variable, and the flow restriction means length and diameter may be changed whenever the nozzle tip diameter changes in order to provide sufficient offset for the reaction force increase. This may be accomplished by configuring the input attachment means to be detachable and interchangeable and configuring the flow restriction means so that it is removable and replaceable with an alternate flow restriction means (of suitable dimensions), or by configuring the flow restriction means mechanically similarly to the adjustable nozzle itself.

E

A DESCRIPTION OF THE DRAWINGS

F

A DESCRIPTION OF THE PREFERRED EMBODIMENT

Figures 1, 2:
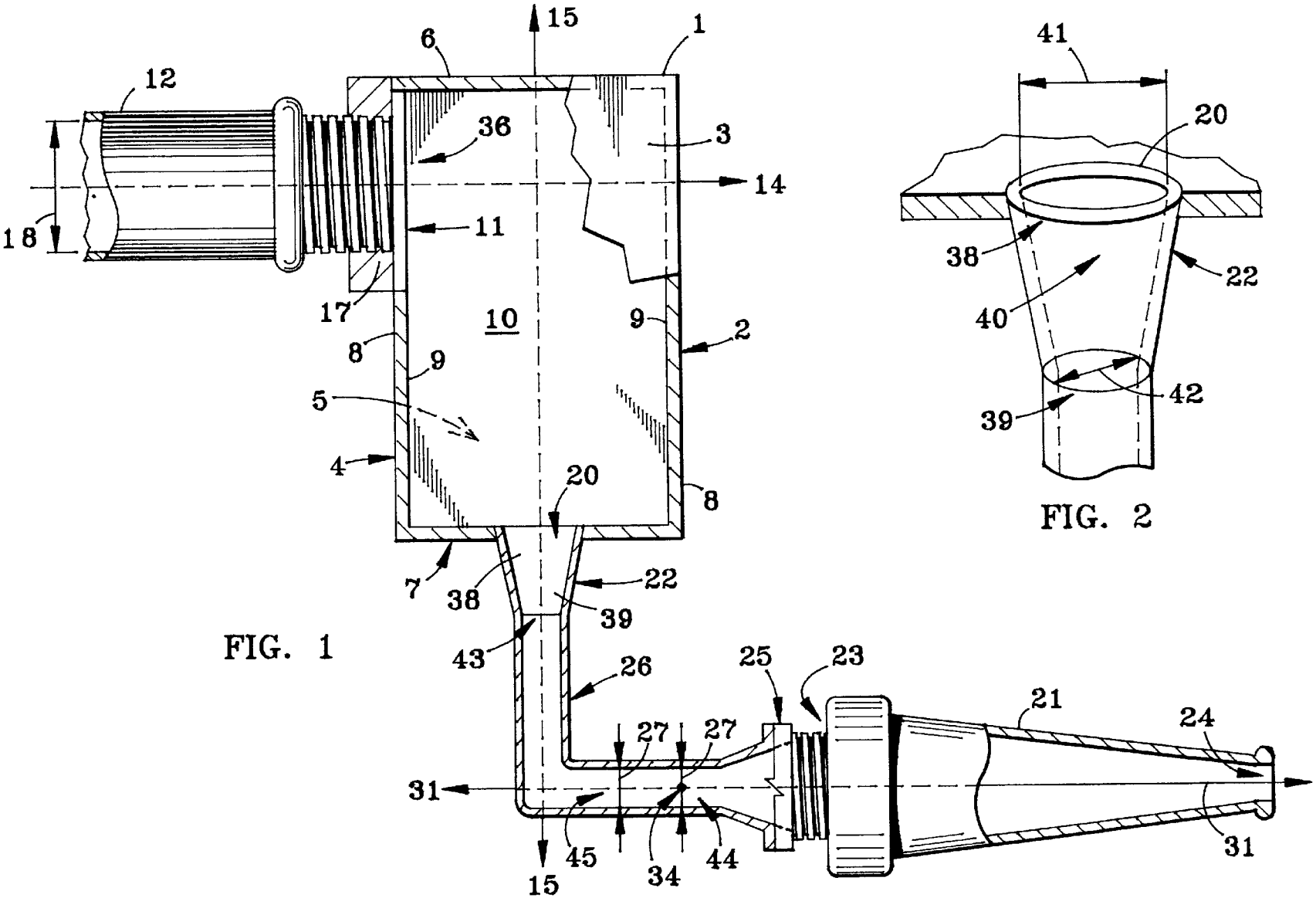
FIG. 1 is a cross sectional view of a first manifestation of the device.
FIG. 2 is a perspective partial cross section of the flow restriction means.

As per FIGS. 1, 4, 7 and 8, the device is constructed of a body (1), having a front side (2) a right side (3) a back side (4) a left side (5), a top side (6) and a bottom side (7). The front side (2), right side (3), back side (4), left side (5), top side (6) and bottom side (7) each having an outer surface, the outer surface being continuous and collectively referred to as the body outer surface (8). The front side (2), right side (3), back side (4), left side (5), top side (6) and bottom side (7) each having an inner surface, the inner surface being continuous and collectively referred to as the body inner surface (9).

Although the device is described as having a right side, a left side, a back side, a front side, a top side and a bottom side, there need be no corners at the intersections of the sides. The body need only have a continuous inner surface defining a hollow chamber (10), within which to contain the high pressure material which will pass through it, a first open end and a second open end.

In the preferred embodiment, the body is constructed of galvanized steel, approximately ⅜ inch thick. However, the body may be constructed of any material having sufficient strength and thickness to withstand the pressure generated both, when the high pressure material is directed against an inner surface, and the pressure encountered by the device when the chamber of the device has filled completely with high pressure material. Furthermore, in the preferred embodiment, there is a distance of approximately 1 and ½ inches between the back side (4) inner surface and the front side (2) inner surface.

As per FIGS. 1, 4, 8 and 9, the body having a body first opening (11). In the preferred embodiment, the body first opening (11) is locatable on the back side and comprises a hole passing through the outer surface and inner surface, for communicating high pressure material from the input device (12) into a chamber (10). As per FIG. 9, the first open end having body first opening diameter (13). As per FIGS. 1 and 4, the first open end diameter being perpendicular to a first horizontal axis (14) and parallel to a first 11 vertical axis (15). As per FIG. 8, the body first opening diameter having a first center point (16). The first horizontal axis passing through the first center point (16) of the body first opening diameter (13).

As per FIGS. 1, 4, 9 and 10, in the preferred embodiment, the body first opening (11) having locatable in connection thereto an input attachment means (17). The input attachment means further having a first open end (35), a second open end (36) and an input attachment means hollow channel (37) for communicating the high pressure material between the first open end (35) and the second open end (36). The input attachment means second open end (36) merging into and being coextensive with the body first opening (11). The input attachment means in the preferred embodiment being configured as a female coupling to permit attachment of an input device (12) (in the preferred embodiment, a high pressure hose), the input device having input device inside diameter (18). In the preferred embodiment, the input attachment means (17) is constructed in conformance with a standard 1 and ½ inch National Pipe Thread female threading. However, the precise configuration of the input attachment means will be dependent upon the coupling requirements of the input device such as a high pressure hose, or whatever high pressure material delivery mechanism to which it will be attached. In the preferred embodiment, the body first opening diameter (13) and the input device inside diameter (18) are approximately 1 and ½ inches. An input attachment means internal diameter (19) being sized for snugly accepting the input device (12). Furthermore, the input attachment means (17) in the preferred embodiment is constructed of galvanized steel having a thickness of ¼ inches, however any material having sufficient strength and thickness to withstand the pressure generated during the flow therethrough of the high pressure material may be utilized.

Figure 4:
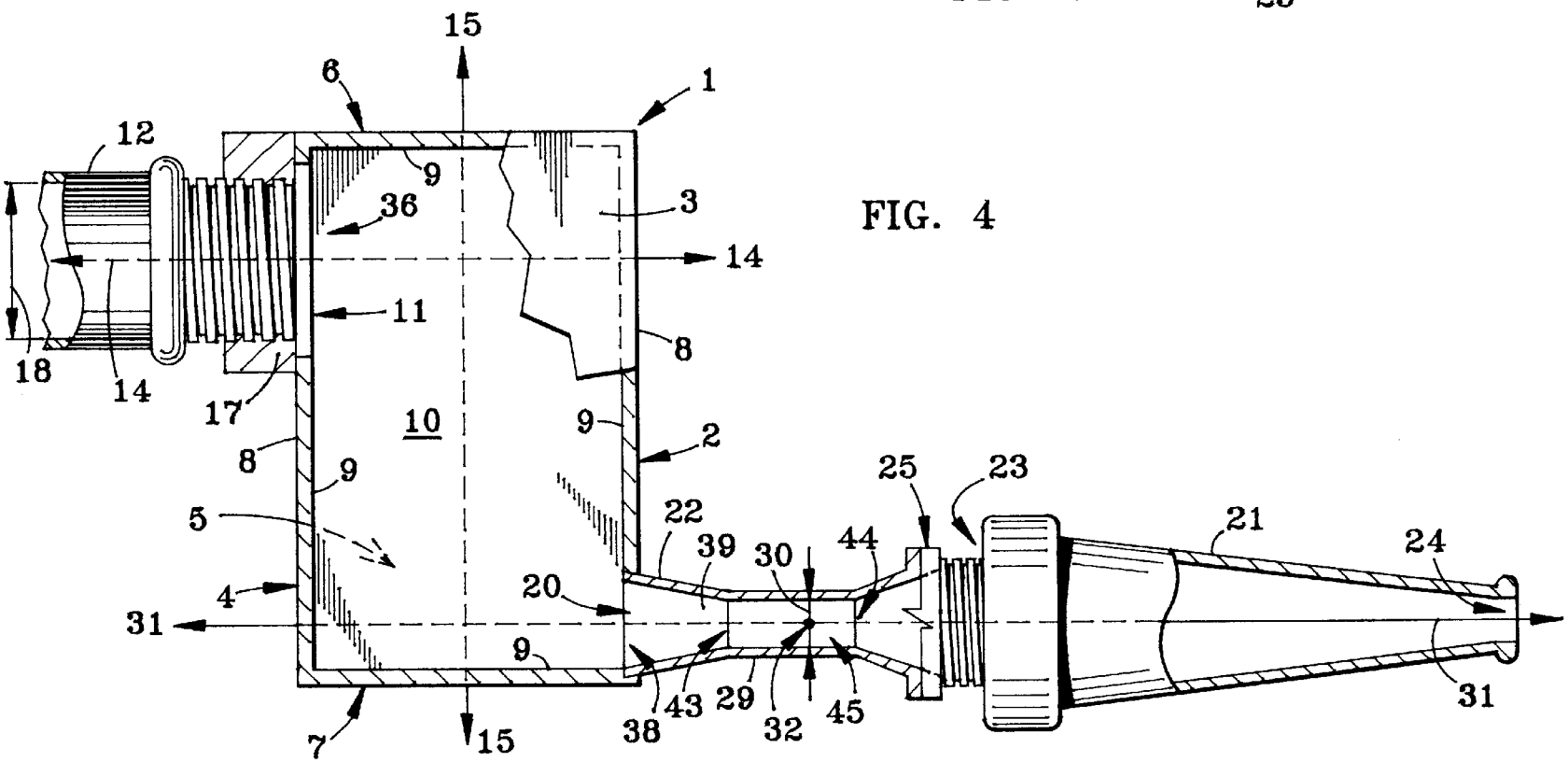
FIG. 4 is a cross sectional view of a second manifestation of the device.
Figure 7:
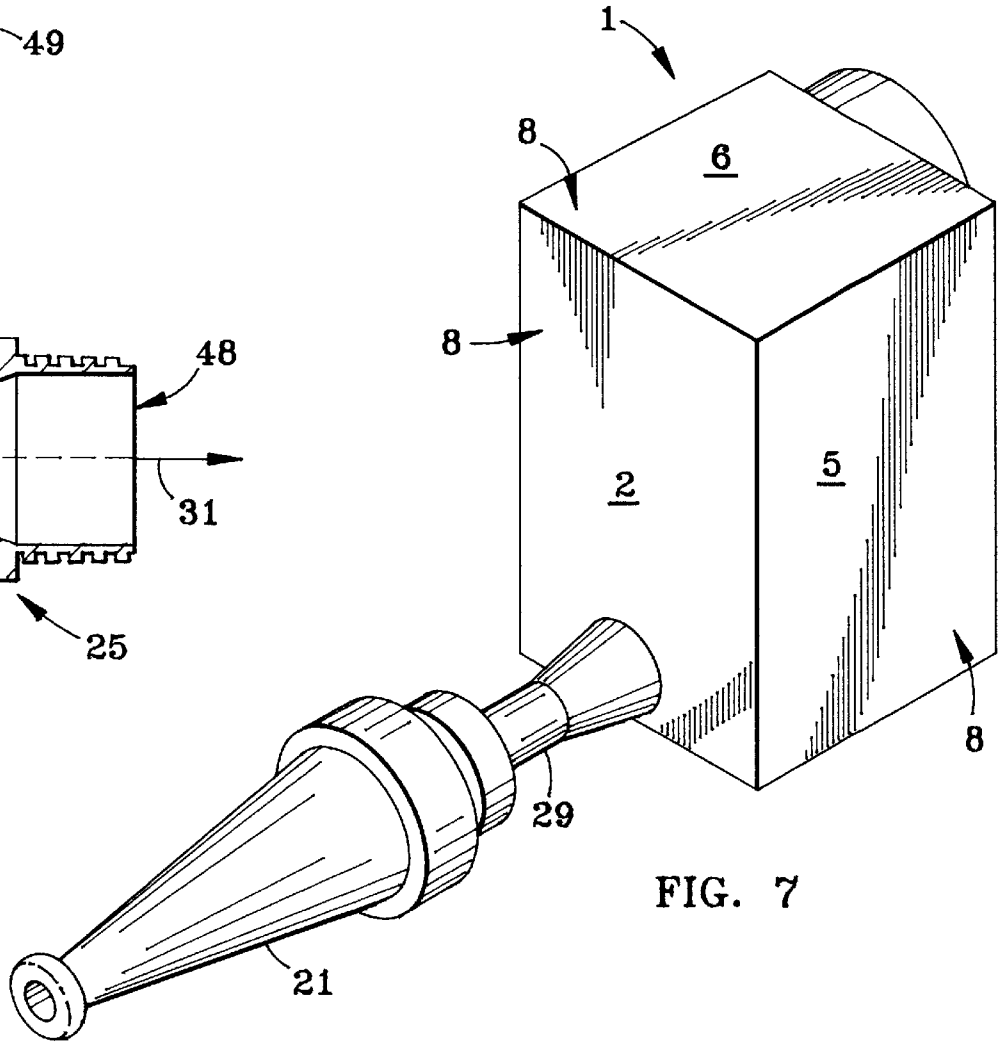
FIG. 7 is a perspective view of the second embodiment of the high pressure recoil reduction device.
Figure 11:
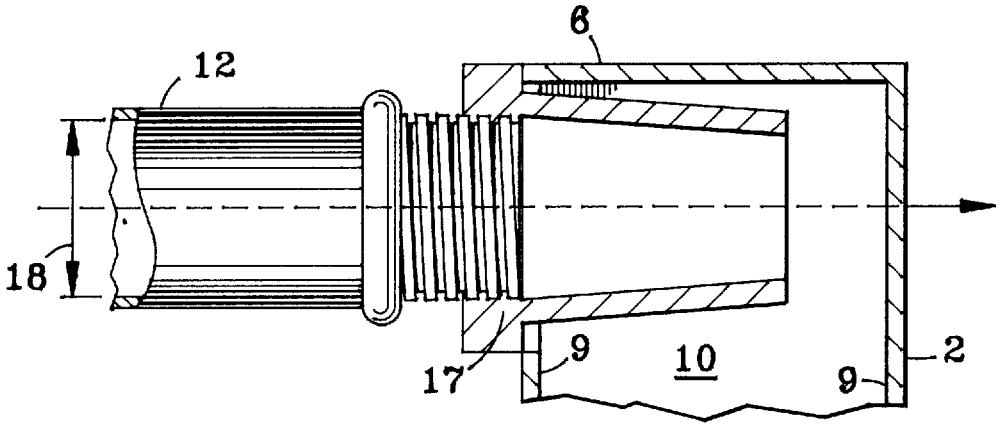
FIG. 11 is a partial cross sectional view of the modified input attachment means.

Although FIGS. 1 and 4 disclose the input attachment means second open end (36) as being nearly flush with the back side (4) outer surface, Applicant believes that it may at times be advantageous to extend the input attachment means (17) through the body first opening (11), into the chamber (10), beyond the back side (4) inner surface. As per FIG. 11, Applicant believes that the input attachment means (17) may extend toward the front side (2) inner surface, so long as the input attachment means is still sufficiently distant from the front side (2) inner surface so as to permit the high pressure material to exit the input attachment means (17), contact the front side (2) inner surface, and pass into the chamber (10) without undue restriction. When configured in this fashion, Applicant believes the input attachment means (17) should extend to within approximately ½ inch of the front side (2) inner surface.

As per FIGS. 1 and 4, the body having a body second opening (20). Two different manifestations of the device are provided in the drawings.

In the first manifestation, as per FIG. 1, the body second opening (20) is locatable on the bottom side (7), the body second opening comprising a hole passing through the outer surface (8) and inner surface (9), for communicating high pressure material from the chamber (10) to an output device (21). In the preferred embodiment, the output device is a smooth bore nozzle having a nozzle first open end (23) and a nozzle second open end (24). The nozzle second open end is also commonly referred to as the "tip" of the nozzle. The nozzle first open end having a diameter of 1 and ½ inches, the nozzle second open end having a diameter of ¾ inch. It should be recognized that commercial nozzles are manufactured with various first end and second end diameters, and the diameters provided here are for example only, and are intended to be in no way limiting.

In the second manifestation, as per FIG. 4, the body second opening (20) is locatable on the front side (2), the body second opening comprising a hole passing through the outer surface (8) and inner surface (9), for communicating high pressure material from the chamber (10) to the output device (21).

In the preferred embodiment, as per FIGS. 1, 2 and 4, the body second opening (20) having attached thereto a flow restriction means (22). The flow restriction means directing the flow of high pressure materials out of the chamber (10), and toward the output device (21). The flow restriction means also serving to increase the pressure of the high pressure material as it passes out of the chamber (10), and assisting in equalizing the pressure of the high pressure material passing out of the chamber (10) with the pressure of the high pressure material as it exits the tip of the nozzle (24). In the preferred embodiment, the flow restriction means is a reducing bushing having a cross sectional diameter at its most narrow point equal to the cross sectional diameter of the tip of the nozzle (24). The tip of the nozzle (24) in the preferred embodiment having a cross sectional diameter of ¾ inches. When configured in this fashion, the mass of the water exiting the chamber (10) should be no greater than the mass of the water exiting the tip of the nozzle (24).

As per FIG. 2, the flow restriction means (22) having a first open end (38), a second open end (39) and a hollow channel (40) for communicating the high pressure material therethrough. The first open end (38) having first open end diameter (41), the second open end (39) having second open end diameter (42).

As per FIGS. 1 and 4, the high pressure material exits the chamber (10) through the flow restriction means (22), and flows toward an output attachment means (25). In the first manifestation of the device, as per FIG. 1, an "L" shaped conduit means (26) is locatable between the output attachment means (25) and the flow restriction means (22). In the preferred embodiment this "L" shaped conduit is formed of galvanized steel having a cross sectional diameter (27) equal to the flow restriction means second open end diameter (42), and a thickness of ¼ inch. In the first manifestation of the device, as per FIGS. 1 and 3, the "L" shaped conduit means has a second horizontal axis (31) perpendicular to the first vertical axis (15), locatable as passing through a center point (34) of the "L" shaped conduit cross sectional diameter (27).

Figure 6:
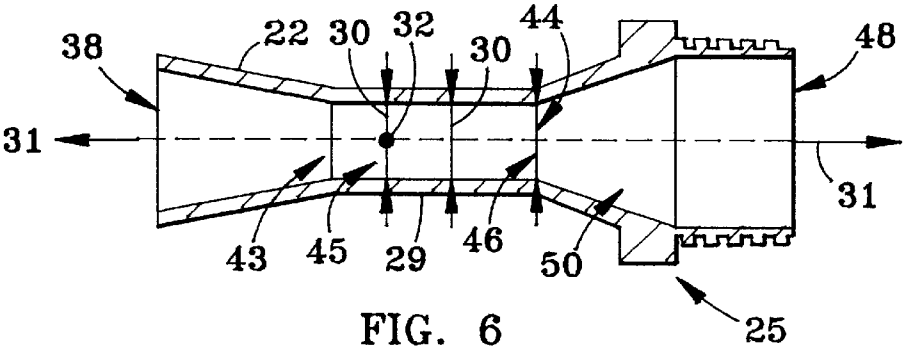
FIG. 6 is a cross sectional view of a second manifestation of the conduit and the output attachment means.
Figure 8:
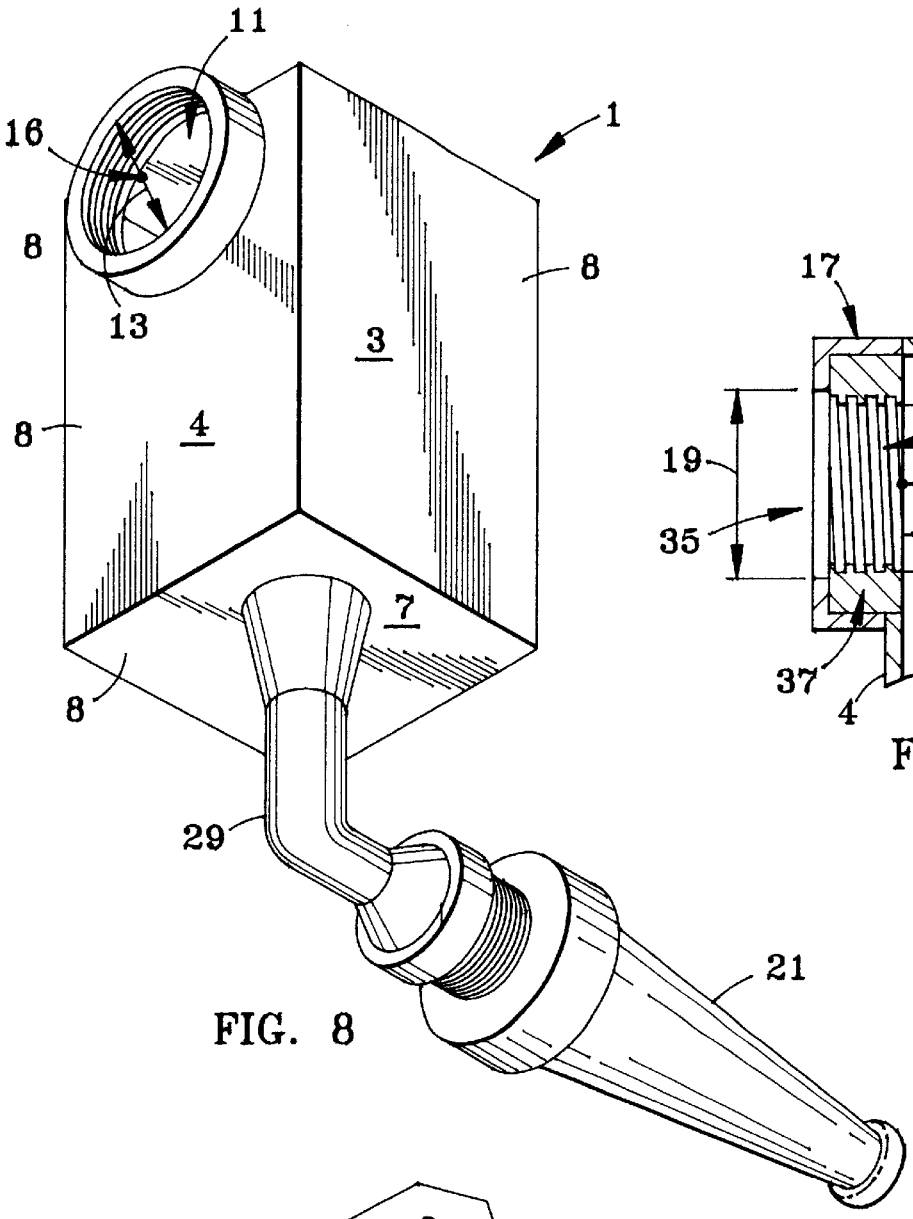
FIG. 8 is a perspective view of the first embodiment of the high pressure recoil reduction device.
Figure 9:
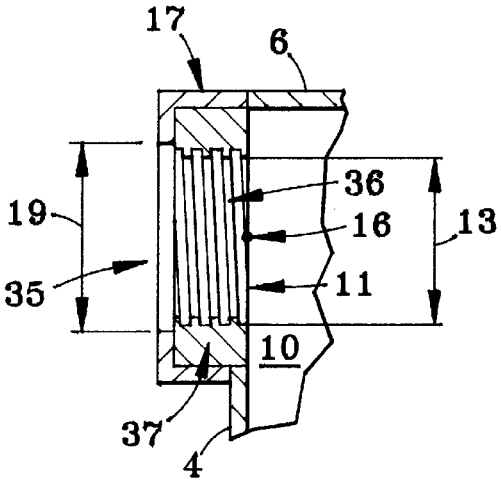
FIG. 9 is a close up cross sectional view of the input attachment means.
Figure 10:
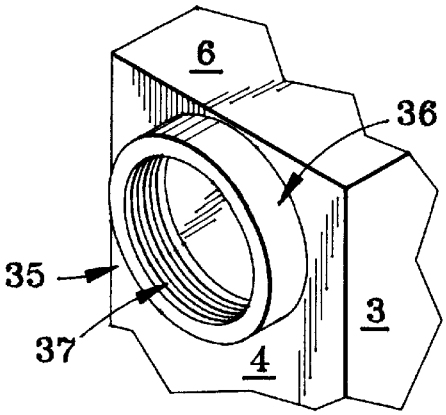
FIG. 10 is a close up perspective view of the input attachment means.

In the second manifestation of the device, as per FIGS. 4 and 6, there is an unbent, or straight conduit means (29) locatable between the flow restriction means (22) and the output attachment means (25). As per FIGS. 4 and 6, the straight conduit means (29) has straight conduit diameter (30), and a second horizontal axis (31) passing through a center point (32) of a straight conduit cross sectional diameter (30). In the preferred embodiment, this straight conduit is formed of galvanized steel having a cross sectional diameter of ¾ inch.

As per FIGS. 1, 4 and 6, the conduit means having a conduit means first open end (43), a conduit means second open end (44) and a conduit means hollow channel (45) for communicating high-pressure material therethrough.

Figure 3:
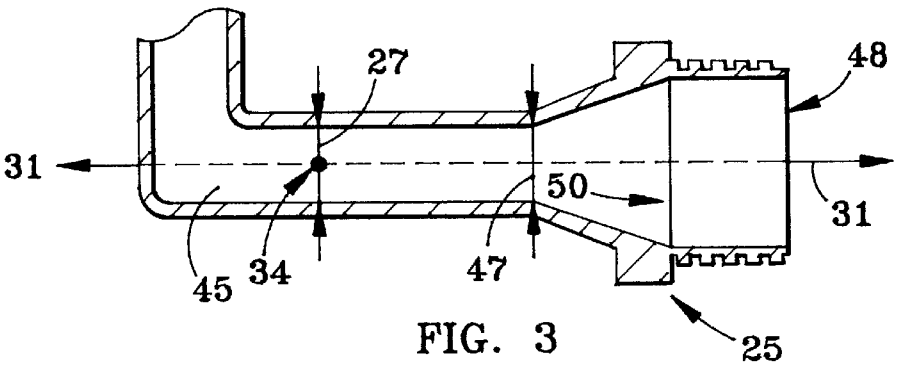
FIG. 3 is a cross sectional view of a first manifestation of the conduit and the output attachment means.
Figure 5:
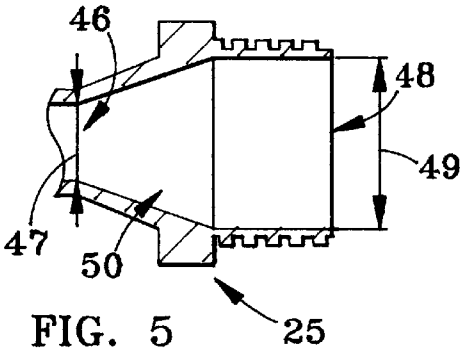
FIG. 5 is a close up cross sectional view of the output attachment means.

As per FIGS. 3, 5 and 6, the output attachment means (25) in the preferred embodiment is a male coupling to permit attachment of a high pressure nozzle (21). The output attachment means having an output attachment means first open end (46), the first open end having first open end diameter (47), an output attachment means second open end (48). As per FIG. 5, the second open end having second open end diameter (49). In the preferred embodiment, the output attachment means second open end diameter being greater than the output attachment means first open end diameter.

As per FIGS. 3, 5 and 6, the output attachment means having an output attachment means hollow channel (50) for communicating high pressure material therethrough. In both the first and second manifestation of the device, the output attachment means (25) is constructed of galvanized steel having a thickness of ¼ inches, however any material having sufficient strength and thickness to withstand the pressure generated during the flow therethrough of the high pressure material may be utilized. Furthermore, in the preferred embodiment, the output attachment means may be a reducing bushing oriented such that it may attach to the ¾ inch conduit and a 1 and ½ inch nozzle first open end, the 1 and ½ inch nozzle first open end being opposite the nozzle tip. In this configuration, the output attachment means will have the standard 1 and ½ inch male National Pipe Threading. However, the precise configuration of the output attachment means will be dependent upon the coupling requirements of the nozzle, or whatever high pressure material spraying mechanism to which it will be attached.

It should be noted that in both manifestations of the preferred embodiment, the first horizontal axis (14) and the second horizontal axis (31) are parallel to one another and offset from one another such that high pressure material passing through the body first opening (11) may not pass directly through the body second opening (20) without first contacting the front side (2) inner surface.

By way of non-limiting example, utilizing the device in connection with fire fighting, the operation of the device may be more readily understood. A high pressure hose (12) is tightly connected to the body of the device (1) at an input attachment means (17). A nozzle (21) is connected to the output attachment means second open end (48).

The high pressure water is then pumped into the hose/device/nozzle system. High pressure water fills the hose (12) and proceeds to the device where it passes through the input attachment means (17) and the body first opening (11). The water, under pressure, emerges into the chamber of the device (10), and continuously strikes the front side (2) inner surface, thereby transferring the water's high pressure force to the device. The high pressure water then fills the chamber (10), and exits the chamber through the body second opening (20). The high pressure water then proceeds through the flow restriction means (22). The high pressure water next proceeds through the conduit (29) or (26), depending upon which manifestation of the device is being utilized, and out through the tip of the nozzle (24).

Applicant believes that the force of the high pressure water striking the front side (2) inner surface, combined with the variation of water pressure brought about at the flow restriction means (22) serves to significantly offset the reactive force produced at the tip of the nozzle (24) during the device's operation, and to provide sufficient water pressure at the tip of the nozzle such that there is little noticeable difference between available water pressure in a hose/nozzle system and a hose/device/nozzle system.

G

I claim:

1. A high pressure hose recoil reduction device comprising;

A. a body;

I. the body having a first opening, a. the body first opening having a body first opening diameter, b. the body first opening having passing longitudinally therethrough a first horizontal axis, at a center point of the body first opening diameter, i. the first horizontal axis being locatable in a first horizontal plane, II. the body having a body second opening, III. the body having a hollow chamber, a. the chamber having a continuous inner surface, i. the continuous inner surface being interrupted only by the body first opening and the body second opening, B. an input attachment means for connecting to a flow of high pressure material, I. the input attachment means having an input attachment means first open end, II. the input attachment means having an input attachment means second open end, III. the input attachment means second open end being attached to the body first opening, IV. the input attachment means having input attachment means diameter and the first horizontal axis passing longitudinally therethrough at a center point of the input attachment means diameter, V. the input attachment means having an input attachment means hollow channel for communicating between the input attachment means first open end and the input attachment means second open end, C. a flow restriction means for restricting the flow of high pressure material from the hollow chamber, I. the flow restriction means having a flow restriction means first open end, a flow restriction means second open end, and a flow restriction means hollow channel for communicating between the flow restriction means first open end and the flow restriction means second open end, II. the flow restriction means being attached to the body second opening, a. the flow restriction means first open end having flow restriction means first open end diameter, b. the flow restriction means second open end having flow restriction means second open end diameter, i. the flow restriction means first open end diameter being greater than the flow restriction means second open end diameter, D. a conduit means for communicating the flow of high pressure material from the flow restriction means, I. the conduit means having a conduit means first open end and a conduit means second open end, II. the conduit means having a conduit means hollow channel for communicating between the conduit means first open end and the conduit means second open end, III. the conduit means first open end being attached to the flow restriction means second open end, a. the conduit means having a conduit means diameter and a second horizontal axis passing longitudinally therethrough at a center point of the conduit means diameter, i. the second horizontal axis being axially offset from the body first opening first horizontal axis, ii. the second horizontal axis being locatable in a second horizontal plane, E. an output attachment means for directing the flow of high pressure material out of the device, I. the output attachment means having an output attachment means first open end, a. the output attachment means first open end having an output attachment means first open end diameter, II. the output attachment means having an output attachment means second open end, b. the output attachment means second open end having an output attachment means second open end diameter, III. the output attachment means having a hollow channel for communicating between the output attachment means first open end and the output attachment means second open end, IV. the output attachment means first open end being connected to the conduit second open end.

2. The high pressure hose recoil reduction device as recited in claim 1, wherein the input attachment means further comprises;

A. the input attachment means second open end extending into the hollow chamber.

3. The high pressure hose recoil reduction device as recited in claim 1, wherein the conduit means further comprises;

A. the conduit means having an "L" shaped configuration.

4. The high pressure hose recoil reduction device as recited in claim 1, wherein the conduit means further comprises;

A. the conduit means having a straight line configuration.

5. The high pressure hose recoil reduction device as recited in claim 1, wherein the input attachment means further comprises;

A. the input attachment means first open end diameter being greater than the input attachment means second open end diameter.

* * * * *